US008899673B2

(12) United States Patent
Holland

(10) Patent No.: US 8,899,673 B2
(45) Date of Patent: Dec. 2, 2014

(54) PORTABLE FOLDING AND RECLINING CHAIR

(71) Applicant: Pro Performance Sports, L.L.C., Carlsbad, CA (US)

(72) Inventor: Allen Holland, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 72 days.

(21) Appl. No.: 13/718,616

(22) Filed: Dec. 18, 2012

(65) Prior Publication Data

US 2014/0167455 A1 Jun. 19, 2014

(51) Int. Cl.
*A47C 4/28* (2006.01)

(52) U.S. Cl.
CPC ..... *A47C 4/286* (2013.01)
USPC ..... 297/45; 297/21

(58) Field of Classification Search
CPC ..... A47C 1/0265; A47C 4/286
USPC ..... 297/45, 21, 22
See application file for complete search history.

(56) References Cited

U.S. PATENT DOCUMENTS

| | | | | |
|---|---|---|---|---|
| 4,715,650 | A | 12/1987 | Berman et al. | |
| 5,882,068 | A | 3/1999 | Levine | |
| 6,179,374 | B1 | 1/2001 | Tang | |
| 6,209,951 | B1 | 4/2001 | Han | |
| 6,237,993 | B1 * | 5/2001 | Zheng | 297/45 X |
| 6,264,271 | B1 * | 7/2001 | Munn et al. | 297/45 |
| 6,296,304 | B1 * | 10/2001 | Zheng | 297/45 |
| 6,402,230 | B1 * | 6/2002 | Tang | 297/45 X |
| 6,419,311 | B1 * | 7/2002 | Tang | 297/45 |
| 6,505,885 | B1 * | 1/2003 | Tang | 297/45 X |
| 6,547,322 | B2 | 4/2003 | Marx | |
| 6,637,811 | B2 | 10/2003 | Zheng | |
| 6,733,070 | B2 * | 5/2004 | Chang | 297/45 X |
| 6,752,452 | B2 | 6/2004 | Choi et al. | |
| 6,779,838 | B2 | 8/2004 | Chang | |
| 6,817,671 | B1 | 11/2004 | Zheng | |
| 8,091,962 | B2 | 1/2012 | Quinn | |
| 8,205,934 | B2 | 6/2012 | Homans | |
| 2002/0014791 | A1 | 2/2002 | Choi | |
| 2005/0140183 | A1 | 6/2005 | Conte | |

FOREIGN PATENT DOCUMENTS

| | | |
|---|---|---|
| JP | 3107102 U | 1/2005 |
| KR | 20-0163853 Y1 | 2/2000 |

OTHER PUBLICATIONS

Korean Intellectual Property Office International Search Report and Written Opinion for International Application No. PCT/US2013/071528, Mar. 17, 2014.

* cited by examiner

*Primary Examiner* — Rodney B White
(74) *Attorney, Agent, or Firm* — Kenneth H. Ohriner; Perkins Coie LLP

(57) ABSTRACT

A folding and reclining chair has first left and right side poles pivotally attached to left and right rear feet. Risers are pivotally attached to the left and right side poles. An angle fitting is rigidly attached to each riser. Back poles are pivotally attached to the angle fittings. A flexible material is attached to or supported by the back poles to provide a back rest. A position lock may be associated with the angle fitting for locking the back pole into one of two or more positions. The chair may be a quad type chair having sliding front and rear connectors.

20 Claims, 6 Drawing Sheets

PORTABLE FOLDING AND RECLINING CHAIR

BACKGROUND OF THE INVENTION

Portable folding chairs have become increasingly popular for use at the beach and parks, at sporting events, for picnics, camping, and similar uses. Many of these chairs are lightweight and fold into a compact size, with the folded chair conveniently carried in a carrying bag. The so-called quad chair design has been in widespread use for several years. The quad chair has a frame typically formed from diagonal poles pivotally attached to each other at the front, back, left and right sides of the frame. This allows the quad chair frame to fold and unfold both in the front to back direction and in the side to side direction. As a result, when folded, the quad chair is highly compact.

Although quad chairs as a whole offer many advantages, most quad chairs have straight backs and do not recline. The limited number of reclining quad chairs that have been proposed have met with varying degrees of success. Providing a reclining quad chair adds complexity to the design. The added elements needed to allow reclining may also add to the size, weight, and cost of the chair, which generally are all important factors. Accordingly, engineering challenges remain in providing a reclining quad chair. Other and further objects and advantages will become apparent from the following detailed description, which shows one embodiment of the invention. It will be apparent though to persons skilled in the art that various other equivalent embodiments may of course be derived within the scope of the invention.

SUMMARY OF THE INVENTION

A folding and reclining chair has first left and right side poles pivotally attached to left and right rear feet. Risers are pivotally attached to the left and right side poles. An angle fitting is rigidly attached to each riser. Back poles are pivotally attached to the angle fittings. A flexible material is attached to or supported by the back poles to provide a back rest. A position lock may be associated with the angle fitting for locking the back pole into one of two or more positions. The chair may be a quad type chair.

BRIEF DESCRIPTION OF THE DRAWINGS

In the drawings, the same element number indicates the same element in each of the views.

DETAILED DESCRIPTION

Figure 1:
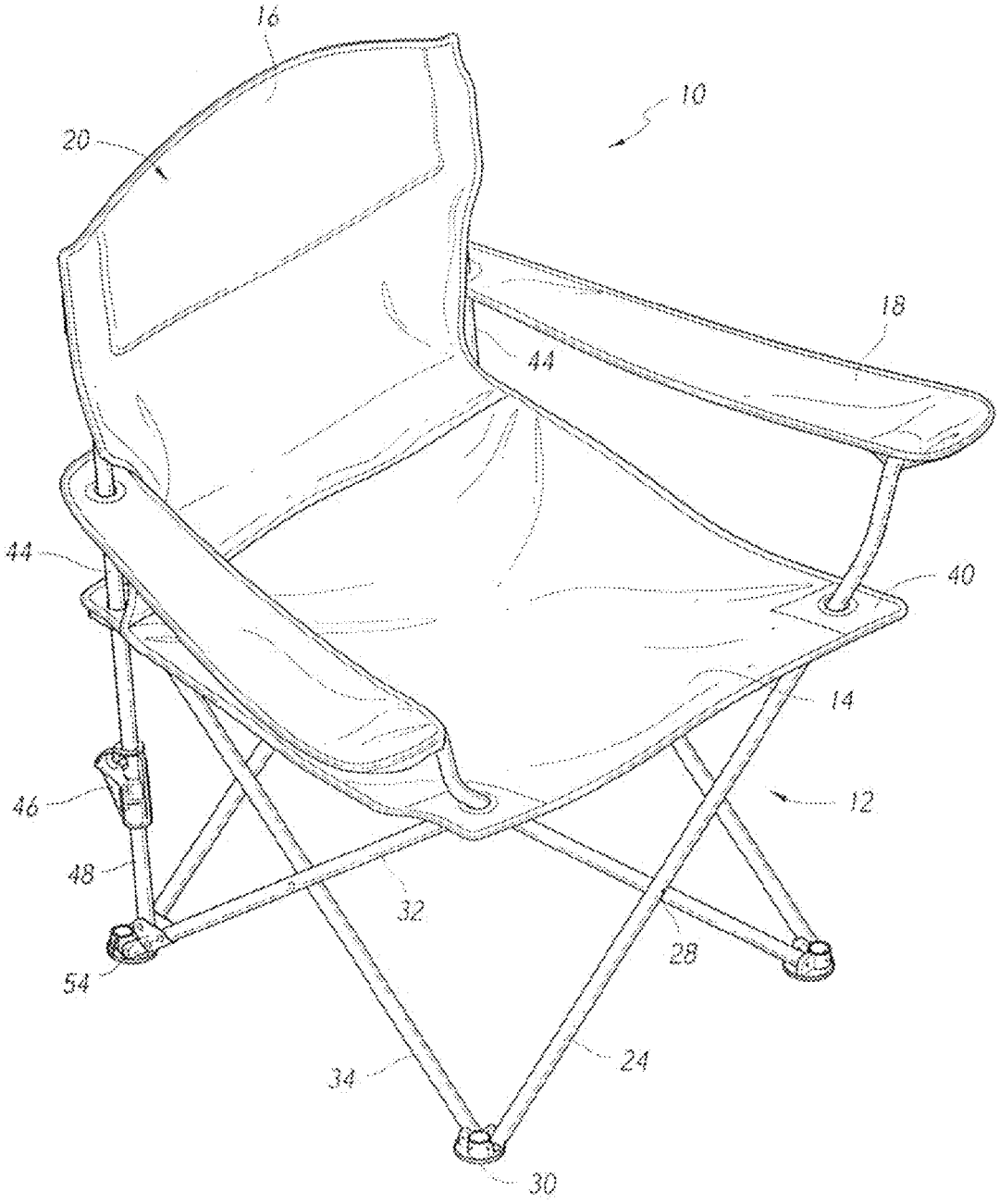
FIG. 1 is a perspective view of a new folding and reclining chair.

As shown in FIG. 1, a portable, foldable and reclining chair 10 has flexible material 14 attached to and/or supported on a frame 12. The material 14 may be a fabric such as polyester or other synthetic or natural material. The material 14 has a seat section 20 and a back section 22 ordinarily provided together as a single piece, but optionally provided as two separate pieces. Typically the chair 10 also has arm rests 18 of the same material.

Figure 2:
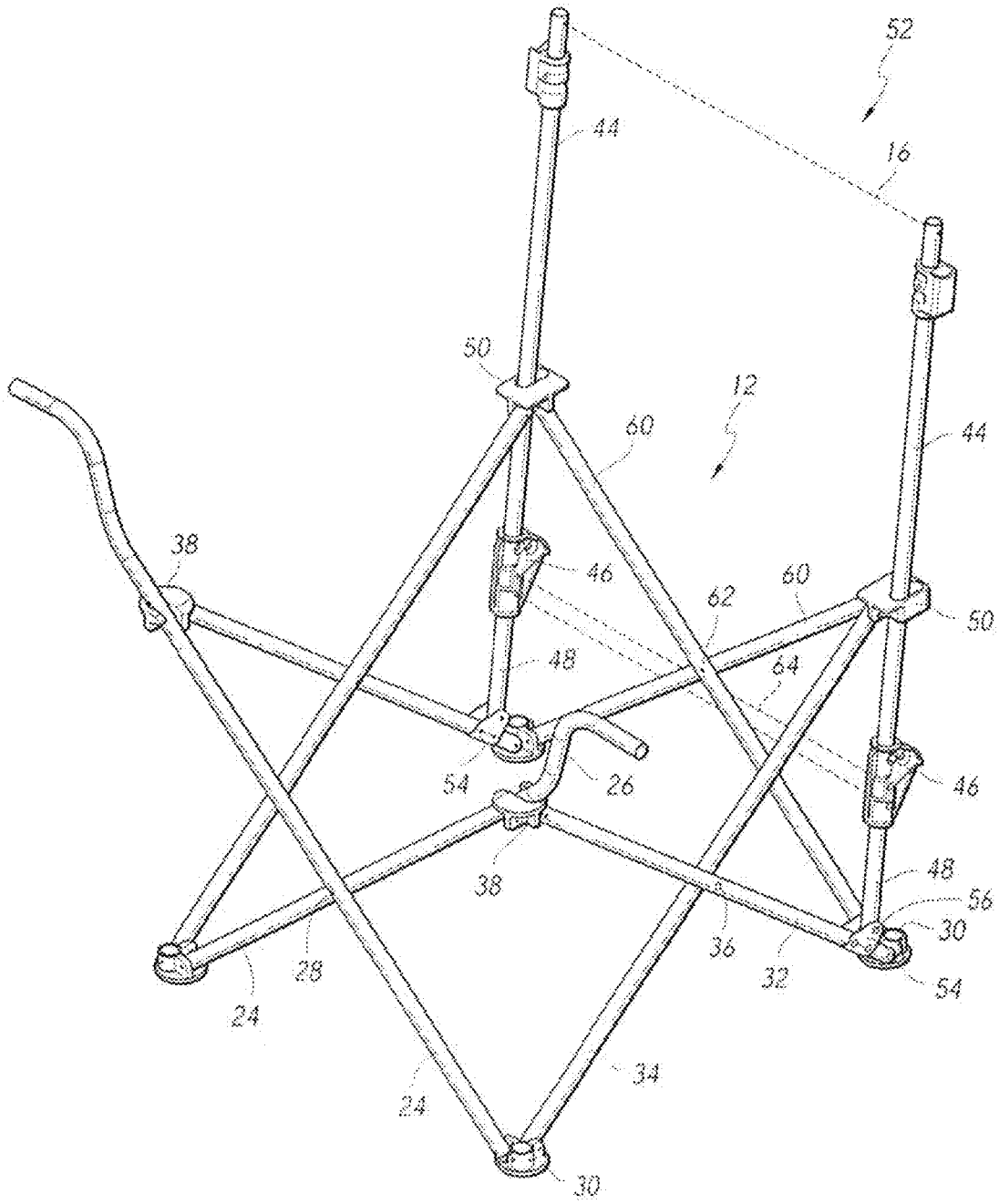
FIG. 2 is a perspective view of the frame of the chair shown in FIG. 1, with the frame in a fully open or erected position.

Turning to FIG. 2, in the example shown, the frame 12 is symmetrical about the front to back centerline. Consequently, the frame elements on the left side may be mirror images of the elements on the right side. The lower end of each front pole 24 is pivotally attached to a front foot 30. The front poles 24 may be pivotally attached to each other at a front pivot joint 28. A joggle end 26 may be provided at the upper end of each front pole 24, to support the arm rests 18. A front sliding connector 38 is slidably provided on each front pole 24 between the joggle or upper end 26 of the front pole 24 and the front pivot joint 28.

The lower end of each rear diagonal pole 60 is similarly pivotally attached to a rear foot 30, and the rear poles may be pivotally attached to each other at a rear pivot joint 62. The upper end of each rear diagonal pole 60 is pivotally attached to an upper rear sliding connector 50. On each side of the frame 12, a first side pole 32 is pivotally connected to a rear foot 30 and to a front sliding connector 38. Also on each side of the frame 12, a second side pole 34 is pivotally connected to a front foot 30 and to an upper rear sliding connector 50. The first and second side poles 32 and 34 may also be pivotally attached to each other at a side pivot joint 36.

Figure 3A:
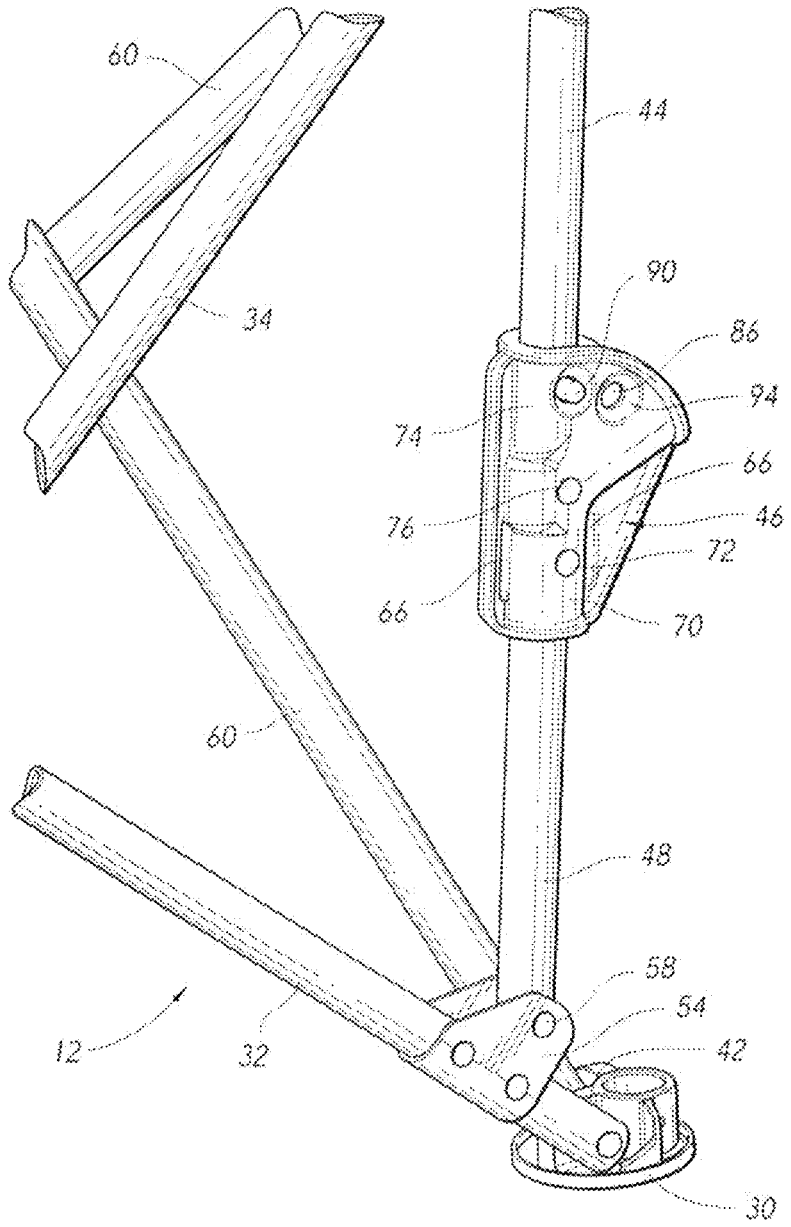
FIG. 3A is an enlarged detail of the lower left side of the frame shown in FIG. 2.

Turning to FIG. 3A, on each side of the frame 12, an optional bracket 54 may be rigidly attached to the first side pole 32, adjacent to the rear foot. In designs using the bracket 54, a lower end of a riser or a short pole segment 48, is pivotally attached to the bracket 54 via a pivot joint 58. The upper end of the riser 48 is rigidly attached to an angle fitting 46. A lower end of a back pole 44 is pivotally attached to the angle fitting 46. The back pole 44 extends through the upper rear sliding connector 50, with the upper ends of the back poles 44 and the seat section 16 of the flexible material forming a back rest generally shown at 52.

Figure 3B:
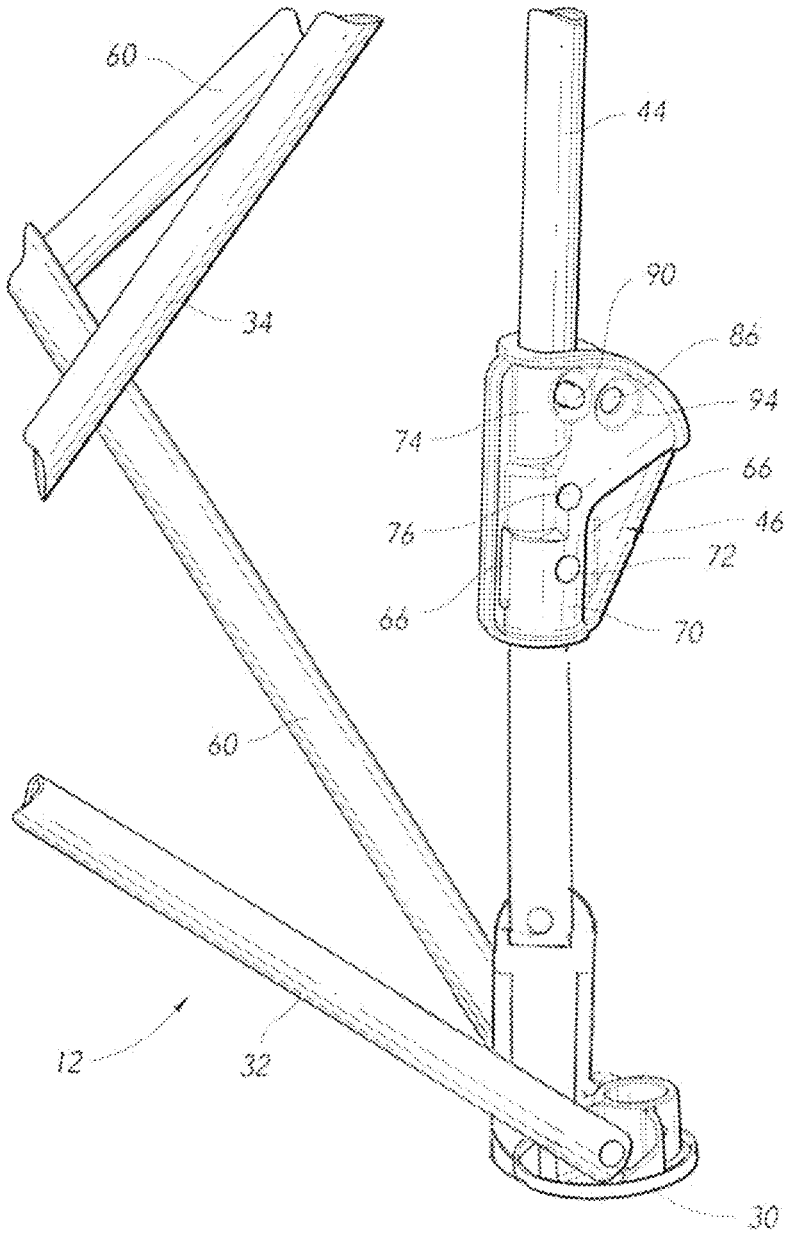
FIG. 3B is an enlarged detail of the lower left side of the frame in an alternative design.

With the back 52 in the upright and un-reclined position shown in FIG. 3A, the back pole 44 may be aligned parallel and concentric with the riser 48. In some designs, the pivot joint 58 may be directly on the first side pole 32 and the bracket 54 omitted. Alternatively, as shown in FIG. 3B, the pivot joint 58 may be provided on an extension of the rear foot 30, also with the bracket 54 omitted. In this design, the vertical plate 42 on the foot 30 may be extended up and/or out, with the pivot joint 58 on the extended vertical plate 42.

The poles and risers described above may be steel or aluminum tubes. The feet 30, and the front and rear sliding connectors 38 and 50 are standard fittings used in the manufacture of quad chairs. While referred to here collectively, the designs of these components are typically mirror images of each other, based on their left/right and front/back positions on the chair, as is well known in the art. The pivot joints 28, 36, and 62, as well as the pivot joints on the feet 30 may be provided using pins, rivets, or other techniques. The flexible material 14 providing the seat and back sections typical has ring fittings at the corners of the seat section 20 that attaches the flexible material to the frame, while allowing sliding movement between them, as with standard quad chairs.

The frame 12 may be similar to a frame of a standard quad chair, which allows the frame to fold and unfold in the same way as a standard quad chair. However, the frame 12 differs from standard quad chair frames as it also allows the seat back 52 to recline, via the risers pivotally attached to the side poles 32, and the back poles 44 pivotally attached to the angle fitting 46.

Figure 4:
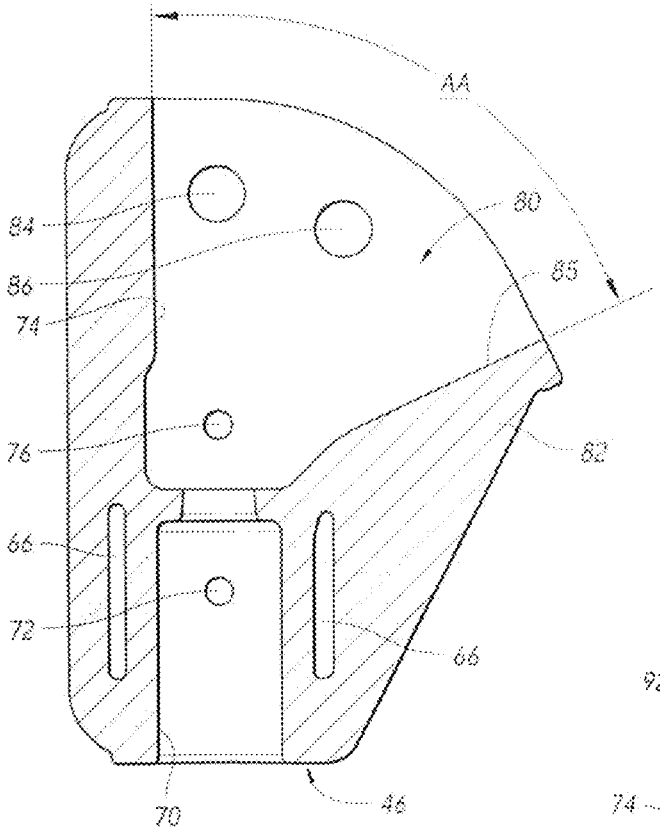
FIG. 4 is a section view in isolation of the angle fitting shown in FIG. 3.
Figure 5:
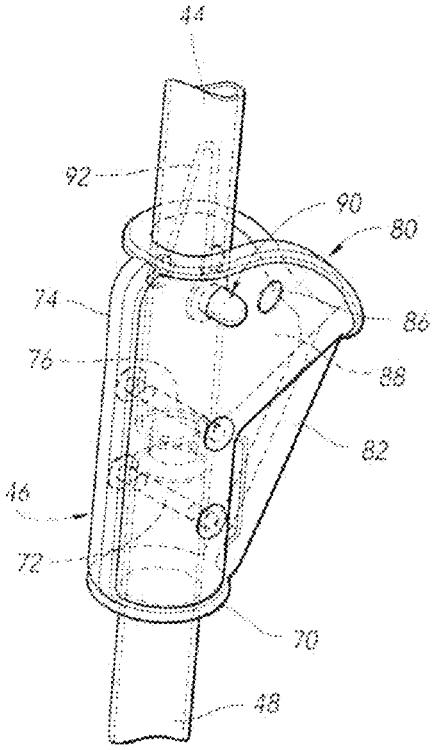
FIG. 5 is a perspective view of the angle fitting shown in FIG. 3.

Referring to FIGS. 4 and 5, on each side of the frame 12, a tubular riser opening 70 may be provided on the lower end of the angle fitting 46. The upper end of the riser 48 is fitted into the riser opening 70 and rigidly attached to the angle fitting 46, for example via a pin, rivet or other fastener 72. The lower end of the back pole 44 extends into a recline slot 80 formed between spaced apart sidewalls 88, a floor 85 and an upright wall 74 of the angle fitting 46. The recline slot subtends and angle AA of about 60 to 80 or 90 degrees. The back pole 44 is pivotally attached to the angle fitting, for example via a pin 72 or an equivalent through the sidewalls 88 and the lower end of the back pole. Of course, in an alternative design, the risers may be pivotally attached, and the back poles rigidly attached to the angle fittings.

Figure 6:
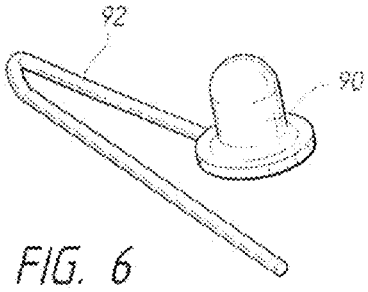
FIG. 6 is a perspective view of the lock button shown in dotted lines in FIG. 5.

First and second position holes 84 and 86 through the inner side wall 88 are aligned on a common radius. A gusset 82 may extend between the riser opening 70 to the floor 85. As shown in FIG. 6, a lock button 90 is attached to a spring 92. The spring 92 is attached to an inside surface of the lower end of each back pole 44. The lock button projects out through a hole in the pole 44 and into the first position hole 84 on the inner sidewall 88. The angle fitting 46 may be an integral molded plastic part, or a cast metal part. The angle fitting 46 may have strap slots 66, with a strap 64 through the slots preventing outward or bowing movement of the back poles 44, for added stability. Alternatively, the strap 64, if used, may be attached to the back poles above the angle fittings 46.

Figure 7:
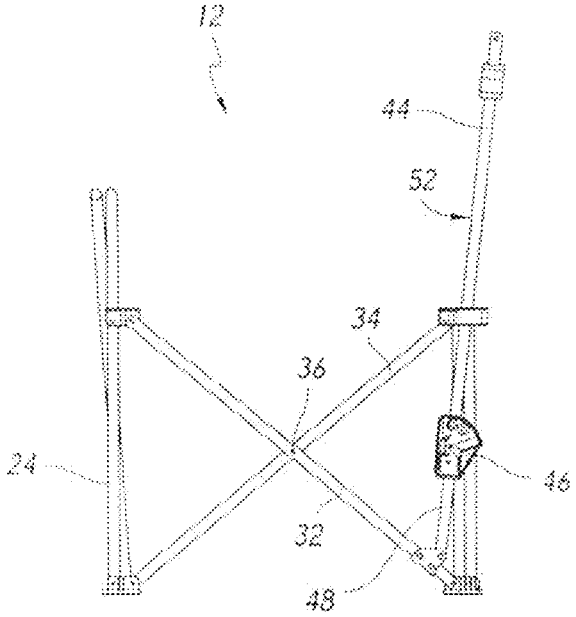
FIG. 7 is a side view of the frame of FIG. 2, with the back of the chair in an upright position.
Figure 8:
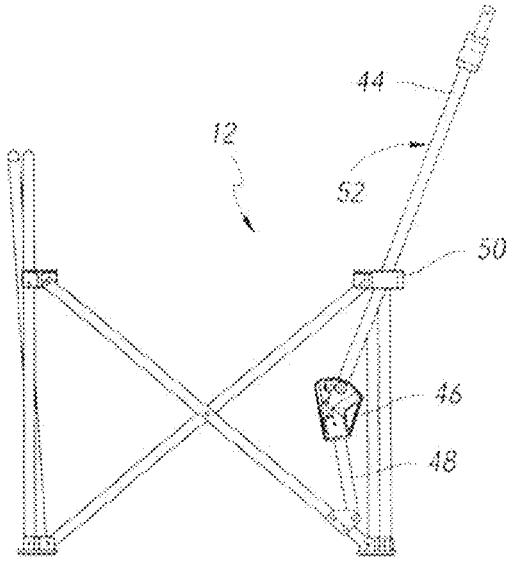
FIG. 8 is a side view of the frame of FIG. 2, with the back of the chair in a partially reclined position.

FIG. 7 shows a side view of the frame 12, with the frame in an upright position. The riser 48 is aligned with and parallel to the back pole 44 on each side. The back pole may be parallel to, and/or in contact with, the upright wall 74. With the chair in the upright position, the back rest 52 is typically inclined rearward by about 5 to 15 degrees. The lock button 90 projects into the first position hole 84. To recline the back rest 52, the user pushes the lock button 90 in on each side. This may be performed with the user standing or kneeling behind the chair 10, and not with anyone sitting in the chair. This allows the back rest 52 to pivot rearward about the pivot point 76, with the back rest 52 moving into the position shown in FIG. 8. As this occurs, the riser 48 and the angle fitting 46 attached to the riser pivot forward about the bracket pivot joint 58.

Once the button 90 moves into alignment with the second position hole 86, the spring 92 causes the button 90 to move into the second position hole 86. The seat back 52 is then locked into the intermediate reclined position shown in FIG. 8.

Figure 9:
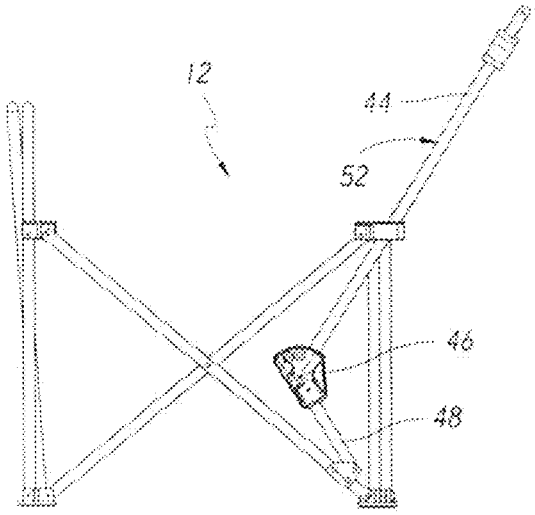
FIG. 9 is a side view of the frame of FIG. 2, with the back of the chair in a fully reclined position.

To fully recline the seat back 52, the button 90 on each side is again pushed in, or held in, allowing the seat back 52 to move into the position shown in FIG. 9. During this movement the riser 48 and the angle fitting 46 joined to the riser swing further forward about the bracket pivot joint 58. In the fully reclined position shown in FIG. 9, the lower end of the back pole 44 may rest against the floor 85 of the angle fitting 46, preventing any further downward pivoting movement of the seat back 52. Optionally, an additional position hole may be provided for locking the seat back 52 against upward or forward movement when the seat back 52 is in the fully reclined position.

The back pole 44 extends through a slot in the upper rear sliding connector 50. The slot allows the back pole 44 to tilt relative to the connector 50. The slot also allows the back pole 44 to slide through the connector during the reclining movement, as well as when folding or unfolding the chair 10.

Thus, a novel folding and reclining chair has been shown and described. Various changes and substitutions may of course be made without departing from the spirit and scope of the invention. The invention, therefore, should not be limited except by the following claims and their equivalents.

The invention claimed is:

1. A folding and reclining chair, comprising:

first left and right side poles pivotally attached to left and right rear feet; left and right risers pivotally attached to the left and right side poles;

left and right angle fittings rigidly attached to the left and right risers, with each angle fitting having a recline slot formed between first and second sidewalls of the angle fitting;

left and right back poles pivotally attached to the left and right angle fittings;

left and right position locks for locking the left and right back poles into one of two or more positions relative to the left and right angle fittings, respectively; and a flexible material attached to or supported by the left and right back poles.

2. The chair of claim 1 with the left and right back poles extending through left and right rear sliding connectors, and with the left and right angle fittings between the left and right sliding connectors and the left and right feet, respectively.

3. The chair of claim 2 further comprising a strap between the left and right back poles.

4. The chair of claim 2 further including:

first and second rear diagonal poles pivotally attached to each other, and with each rear diagonal pole having a lower end pivotally attached to one of the rear feet, and having an upper end pivotally attached to one of the rear sliding connectors;

left and right front sliding connectors attached to a front end of the left and right first side poles; second left and right side poles pivotally attached to the left and right sliding connectors, pivotally attached to the first left and right side poles, and pivotally attached to left and right front feet; and first and second front poles pivotally attached to the left and right front feet, pivotally attached to each other, and with an upper end of each front pole extending through the left and right front sliding connectors, respectively; and the flexible material having a seat section supported by the first and second front poles.

5. The chair of claim 1 with the left and right back poles substantially co-axial with the left and right risers, respectively, when the chair is in an upright position, and with the left and right back poles movable to form an acute angle with the left and right risers, when the chair is in a reclined position.

6. The chair of claim 1 with the recline slot of each angle fitting formed between the first and second sidewalls, a floor, and an upright wall of the angle fitting.

7. The chair of claim 6 with the recline slot extending over an angle ranging from 60 to 90 degrees.

8. The chair of claim 1 with the left and right position locks each comprising a lock button supported on a spring inside of the left and right back poles, respectively, with the lock button moveable into one of two or more openings in the second sidewall.

9. The chair of claim 1 wherein the left and right risers are pivotally attached to the left and right brackets at riser pivot joints, and wherein the left and right first side poles are pivotally attached to the left and right rear feet at first side pole pivot joints, and wherein the riser pivot joints and the first side pole pivot joints are spaced apart by 0.5 to 6 inches.

10. The chair of claim 1 further comprising left and right brackets rigidly attached to the left and right side poles, and with the left and right risers pivotally attached to the left and right brackets.

11. A reclinable folding chair, comprising:

a frame including:

first left and right side poles pivotally attached to left and right rear feet;

left and right risers pivotally attached to the left and right side poles;

left and right angle fittings rigidly attached to the left and right risers, with each angle fitting having a recline slot formed between first and second sidewalls of the angle fitting;

left and right back poles pivotally attached to the left and right angle fittings and extending through left and right rear sliding connectors;

first and second rear diagonal poles pivotally attached to each other, and with the first rear diagonal pole having a lower end pivotally attached to the left rear foot and having an upper end pivotally attached to the right rear sliding connector, and with the second rear diagonal pole having a lower end pivotally attached to the right rear foot and having an upper end pivotally attached to the left rear sliding connector;

left and right front sliding connectors attached to a front end of the left and right first side poles;

a second left side pole having an upper end pivotally attached to the left rear sliding connector and having a lower end pivotally attached to a front left foot, and with the second left side pole pivotally attached to the first left side pole;

a second right side pole having an upper end pivotally attached to the right rear sliding connector and having a lower end pivotally attached to a front right foot, and with second right side pole pivotally attached to the first right side pole;

a first front pole having a lower end pivotally attached to the right front foot, and having an upper end extending through a front right sliding connector;

a second front pole having a lower end pivotally attached to the left front foot, and having an upper end extending through a front left sliding connector, and with the first front pole pivotally attached to the second front pole; and a flexible material having a seat section and a back section supported on the frame.

12. The chair of claim 11 wherein the frame is symmetrical about a front to back centerline.

13. The chair of claim 11 with the back section supported on the back poles.

14. The chair of claim 11 further comprising left and right locking mechanisms associated with the left and right angle fittings, for locking the left and right back poles into a selected position.

15. The chair of claim 11 with the flexible material having ring fittings slidably supported on the back poles.

16. The chair of claim 11 further comprising a strap between the left and right back poles extending through slots in the angle fittings.

17. A folding and reclining chair, comprising:

first left and right side poles pivotally attached to left and right rear feet; left and right risers pivotally attached to the left and right side poles;

left and right angle fittings rigidly attached to the left and right risers;

left and right back poles pivotally attached to the left and right angle fittings;

left and right position locks for locking the left and right back poles into one of two or more positions relative to the left and right angle fittings, respectively;

a flexible material attached to or supported by the left and right back poles;

with the left and right back poles extending through left and right rear sliding connectors, and with the left and right angle fittings between the left and right sliding connectors and the left and right feet, respectively; and a strap between the left and right back poles.

18. The chair of claim 17 with each angle fitting having a recline slot formed between first and second sidewalls of the angle fitting.

19. A folding and reclining chair, comprising:

a first left side pole pivotally attached to a left rear foot;

a first right side pole pivotally attached to a right rear foot;

a left riser pivotally attached to the left side pole or to the left rear foot;

a right riser pivotally attached to the right side pole or to the right rear foot;

a left angle fitting pivotally attached to the left riser;

a right angle fitting pivotally attached to the right riser;

with each angle fitting having a recline slot formed between first and second sidewalls of the angle fitting;

a left back pole rigidly attached to the left angle fitting;

a right back pole rigidly attached to the right angle fitting;

left and right position locks for locking the left and right risers into one of two or more positions relative to the left and right angle fittings, respectively; and a flexible material attached to or supported by the left and right back poles.

20. The chair of claim 19 with the left and right back poles extending through left and right rear sliding connectors, and with the left and right angle fittings between the left and right sliding connectors and the left and right feet, respectively.

* * * * *